United States Patent [19]

Hemala et al.

[11] 4,102,115

[45] Jul. 25, 1978

[54] COMPRESSED AIR SUPPLY ARRANGEMENT FOR A SERVICE CARRIAGE

[75] Inventors: Zdenek Hemala; Guenter Nudinger, both of Kempten; Gerhard Wehrmeister, St. Mang, all of Germany

[73] Assignee: Saurer-Allma GmbH, Kempten, Germany

[21] Appl. No.: 727,147

[22] Filed: Sep. 27, 1976

[30] Foreign Application Priority Data

Oct. 4, 1976 [DE] Fed. Rep. of Germany ..... 7531565

[51] Int. Cl.[2] ..... D01H 13/00; D01H 9/10

[52] U.S. Cl. ..... 57/34 R; 57/53

[58] Field of Search ..... 57/34 R, 53; 137/609; 251/149.6

[56] References Cited

U.S. PATENT DOCUMENTS

| | | | |
|---|---|---|---|
| 1,318,674 | 10/1919 | Knoll | 251/149.6 X |
| 1,740,015 | 12/1929 | Hooper et al. | 251/149.6 |
| 1,846,877 | 2/1932 | Knapp | 251/149.6 X |
| 3,373,551 | 3/1968 | Gillono et al. | 57/53 X |
| 3,442,072 | 5/1969 | Gillono et al. | 57/53 |

*Primary Examiner*—Richard C. Queissser
*Assistant Examiner*—Charles Gorenstein
*Attorney, Agent, or Firm*—Blanchard, Flynn, Thiel, Boutell & Tanis

[57] ABSTRACT

A service carriage for use with a spinning, twisting or winding frame which has a plurality of equally spaced spindles and a plurality of equally spaced work stations thereon. A compressed air system on the carriage is supplied with compressed air from a source of compressed air via a compressed air duct. The compressed air duct is fixedly arranged at each side of the frame and extends in the longitudinal direction of the frame and is connected to the compressed air source. The air duct has a plurality of automatically closing button-actuated valves which are connected in circuit therewith. Each of the valves has a closure member associated therewith. The spacing between the valves corresponds to a whole integer multiple of the spindle spacing. A plurality of coupling heads are arranged one behind the other in the direction of movement of the carriage and are mounted on a common slide member. Support structure is provided for supporting the common slide member for movement transversely to the direction of movement of the carriage and at right angles to the air duct. The coupling heads each have an opening member engageable with the closure member for opening the closure member when it is firmly engaged with the valve. The coupling heads are connected in fluid circuit to the compressed air system on the service carriage.

6 Claims, 5 Drawing Figures

D3
D1
D2
3
6.
7
8
9.
11
12
13
15
16
17
18
19
E
C
III
IV

COMPRESSED AIR SUPPLY ARRANGEMENT FOR A SERVICE CARRIAGE

FIELD OF THE INVENTION

The invention relates to a compressed air supply arrangement for a service carriage which can travel along the side of at least one spinning, twisting or winding frame comprising a plurality of equally spaced (in accordance with the spindle distribution) work stations to be serviced, and the compressed air system of which is supplied via a connecting duct from a stationary source of compressed air.

BACKGROUND OF THE INVENTION

In order to automate the manual work performed in the removal of broken threads and in the presentation of the thread in spinning, twisting or winding frames, service carriages are known that travel along the sides of the frame. The carriage may for example be one which is provided with a knotter (see German Patent No. 2,035,025). However, service carriages have already been proposed that permit the automatic presentation of a thread, i.e. which draw the thread from the supply bobbin, through the various parts of the frame and present it to the take-up bobbin. Although these service carriages have an electrical drive for moving them along the side of the frame and also other electrically moved parts, these service carriages also include a plurality of pneumatically driven devices. For picking up and conveying the thread suction nozzles, blower nozzles and injectors are provided. Furthermore, compressed air cylinders are provided for moving the various parts. Also, the suction effect at the suction nozzles is often created by injectors or the like driven by compressed air, so that such a service carriage has a high consumption of compressed air.

In principle, it should be possible to generate the compressed air by means of a compressor arranged in the frame and driven by an electric motor. However, in order that the large quantity of compressed air required for rapid operation of the service carriage may be available at all times, there must be provided on the carriage, in addition to the compressor, a compressed air reservoir of large volume. This compressor and its associated compressed air reservoir, however, greatly increase the weight of the service carriage. This increase in weight conflicts with the efforts made to keep the service carriage as small as possible in order that it may be rapidly accelerated and stopped and that the guide rails that it requires may be of as light construction as possible. Also, in most cases there is insufficient space on the service carriage for a large compressor with its compressed air reservoir, since the carriage already contains a large number of other devices. In a service carriage in which the suction effect is created by only one suction blower (see German Patent No. 1,685,932) difficulties likewise occur owing to the space required by a sufficiently powerful blower and its weight.

In the case of a compressed air supply arrangement of the type mentioned initially it is therefore already known (see German Auslegeschrift 2,360,084) to provide a stationary source of compressed air, i.e., a compressor, and to feed the compressed air to the service carriage via a flexible hose which is dragged along by the carriage. This hose may be connected either to the compressed air mains that are provided in many factories, or to a stationary compressor arranged on the frame. A hose which is dragged along and is under pressure is however subjected to continuous flexing and hence to rapid wear. Furthermore, an automatically winding hose reel must be provided. In spite of this precaution the service carriage was able to move along only one frame, and always had to be moved back to its starting position by a return movement. Such a to and fro movement has the disadvantage, however, that the service carriage, in the vicinity of its point of reversal, again passes, after a relatively short time, the spindles that have already been serviced or inspected, whilst it takes a relatively long time before it again reaches the spindles at the other point of reversal. A circulatory movement of the service carriage in one direction would be preferable in this connection.

The invention is based on the problem of providing a compressed air supply arrangement for a service carriage of the type referred to initially, which whilst avoiding the above-mentioned disadvantages permits the supply of compressed air to one or more service carriages, the service carriage or carriages being capable of travelling along one or more frames independently of the compressed air supply, and the compressed air supply arrangement itself requiring only very little space on the carriage.

In accordance with the invention this is achieved by arranging on each side of the frame a stationary compressed air duct extending in the direction of the frame and connected to the compressed air source, the duct having a plurality of automatically closing button-actuated valves, by arranging for the spacing of the valves to correspond to spindle distribution or a whole multiple thereof, and by providing on the service carriage at least one coupling head which is movable transversely to the direction of movement of the carriage and which is provided with an opening member which when firmly applied to the valve opens it, the coupling head being connected to the compressed air system of the service carriage.

Since with this novel compressed air supply arrangement the source of compressed air is provided externally of the service carriage, the carriage is not substantially loaded by the compressed air supply arrangement, and the compressed air supply arrangement requires only a minimum space on the carriage. The necessary compressed air may be generated by a stationary compressor arranged in one of the spinning, twisting or winding frames, or it may be taken from a compressed air supply main already present. Such a stationary compressor may be of sufficiently large construction to generate the required quantity of compressed air. In a central compressed air supply main a large quantity of compressed air is available. During the movement of the service carriage along the frame this is separated from the stationary compressed air duct. Only when the carriage has come to a standstill at a spindle to be serviced is a connection made between the coupling head which is movable on the carriage and the appropriate valve. The service carriage, since it is not connected to a hose to be dragged along, can therefore move in any desired direction, even along both sides of a frame or along the sides of a plurality of frames. Also, with the novel compressed air supply arrangement a plurality of service carriages may be supplied at the same time, if this is necessary.

Advantageously, there are provided on the service carriage a plurality of coupling heads arranged one behind the other in the direction of movement of the carriage, their spacing corresponding to the spindle distribution, the spacing of the valves being greater by one spindle spacing than the spacing of the two outer coupling heads from one another. In this manner the number of valves is reduced, without it being necessary to increase the number of coupling heads to the same extent as the number of valves is reduced. Thus for example it is advantageous if plug valves are provided only at each fourth spindle and the service carriage has four coupling heads arranged one behind the other at the same spacing as the spindle distribution. It is immaterial which of the four spindles has to be serviced and in front of which the service carriage therefore comes to a standstill. One of the coupling heads always registers with a valve provided at the four spindles and establishes communication with the compressed air duct located in the frame.

BRIEF DESCRIPTION OF THE DRAWINGS

The invention will be explained below in more detail with reference to the practical example illustrated in the drawings, in which.

DETAILED DESCRIPTION

Figure 1:
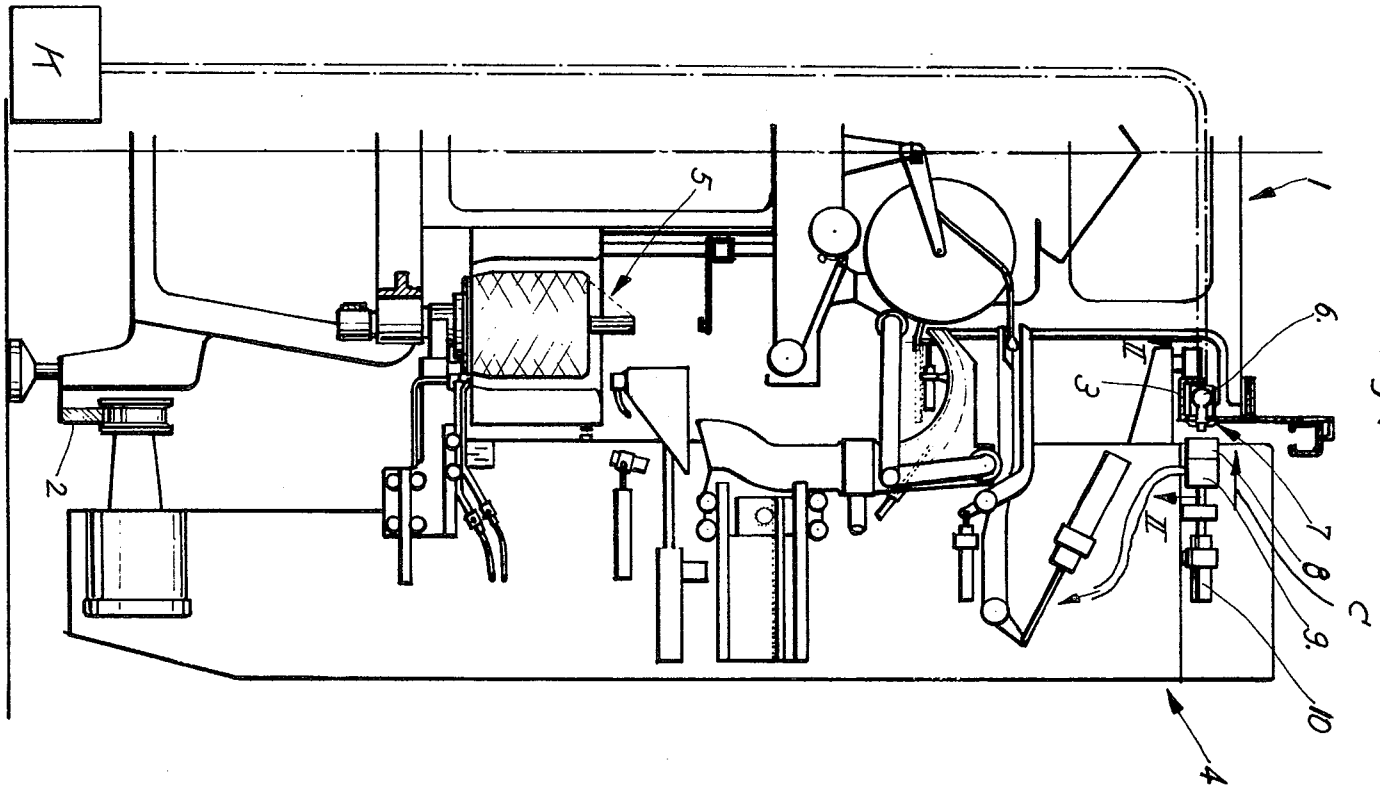
FIG. 1 shows a partial cross-section through a double twist thread twisting frame with the compressed air supply device according to the invention and a service carriage.

In the drawings, one half of a double twist thread twisting frame is indicated at 1. Rails 2 and 3 are arranged on its sides. On these rails the service carriage 4 is located for travel in the longitudinal direction of the frame, viz. perpendicular to the plane of the drawing in FIG. 1. This service carriage may, via various devices known in themselves and therefore not shown in detail, be brought to a standstill at each work station, viz. at each spindle 5, if thread breakage has occurred at this spindle or a thread is to be newly applied. For the performance of this work the service carriage contains a plurality of devices driven by compressed air, which require a relatively large quantity of compressed air, particularly in the creation of a vacuum by injector action.

Figure 5:
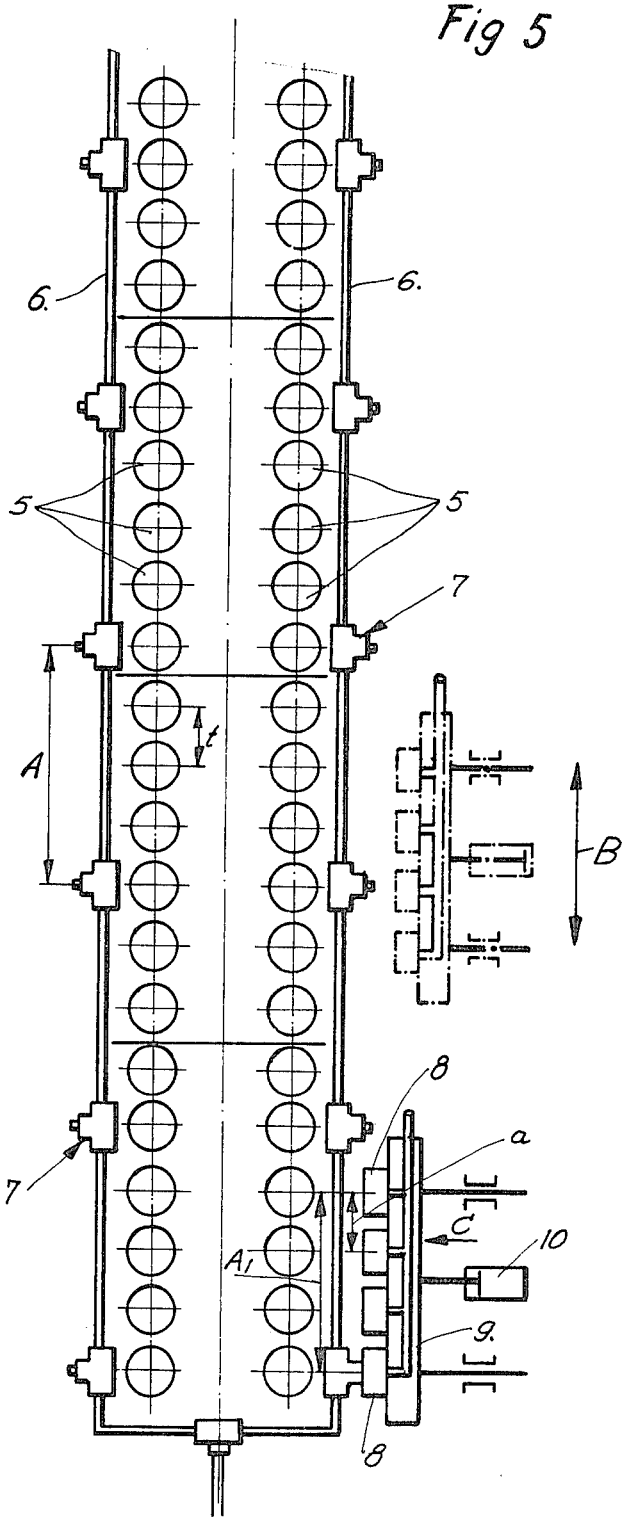
FIG. 5 is a diagrammatic plan view of the compressed air supply device.

For the supply of compressed air, in accordance with the invention there is provided at each side of the frame a compressed air pipe 6 extending in the longitudinal direction of the frame and connected to the source of compressed air. This compressed air pipe 6 is, in the practical example illustrated, arranged in the running rail 3. The compressed air source may for example be a compressor K (FIG. 1) provided in one of the frames, or the compressed air pipe may be connected to a central compressed air main. The compressed air pipe 6 has a plurality of automatically closing valves 7. The spacing of the valves 7 preferably corresponds to a multiple of the spindle distribution spacing *t* (FIG. 5), it having been found advantageous if a valve 7 is provided at each fourth spindle. The distance A then corresponds to five spindle divisions *t*. On the service carriage 4 there are preferably provided a plurality of coupling heads 8 arranged one behind another in the direction of movement of the carriage, the spacing *a* of the coupling heads 8 corresponding to the spindle distribution *t*. In the example illustrated four coupling heads are arranged one behind another. The spacing A of the valves 7 is greater by one spindle spacing *t* than the spacing A1 of the two outer coupling heads 8. This system has the advantage that a valve does not have to be incorporated at each spindle. It would however also be conceivable to associate a valve with each spindle, only one coupling head then needing to be provided on the service carriage 4.

The coupling heads 8 are arranged on a common slide 9 extending in the direction of movement B of the service carriage 4 and movable transversely to this direction of movement and at right angles to the plug points 7, in the direction C. A compressed air cylinder 10 serves to drive the slide.

Figures 2, 3, 4:
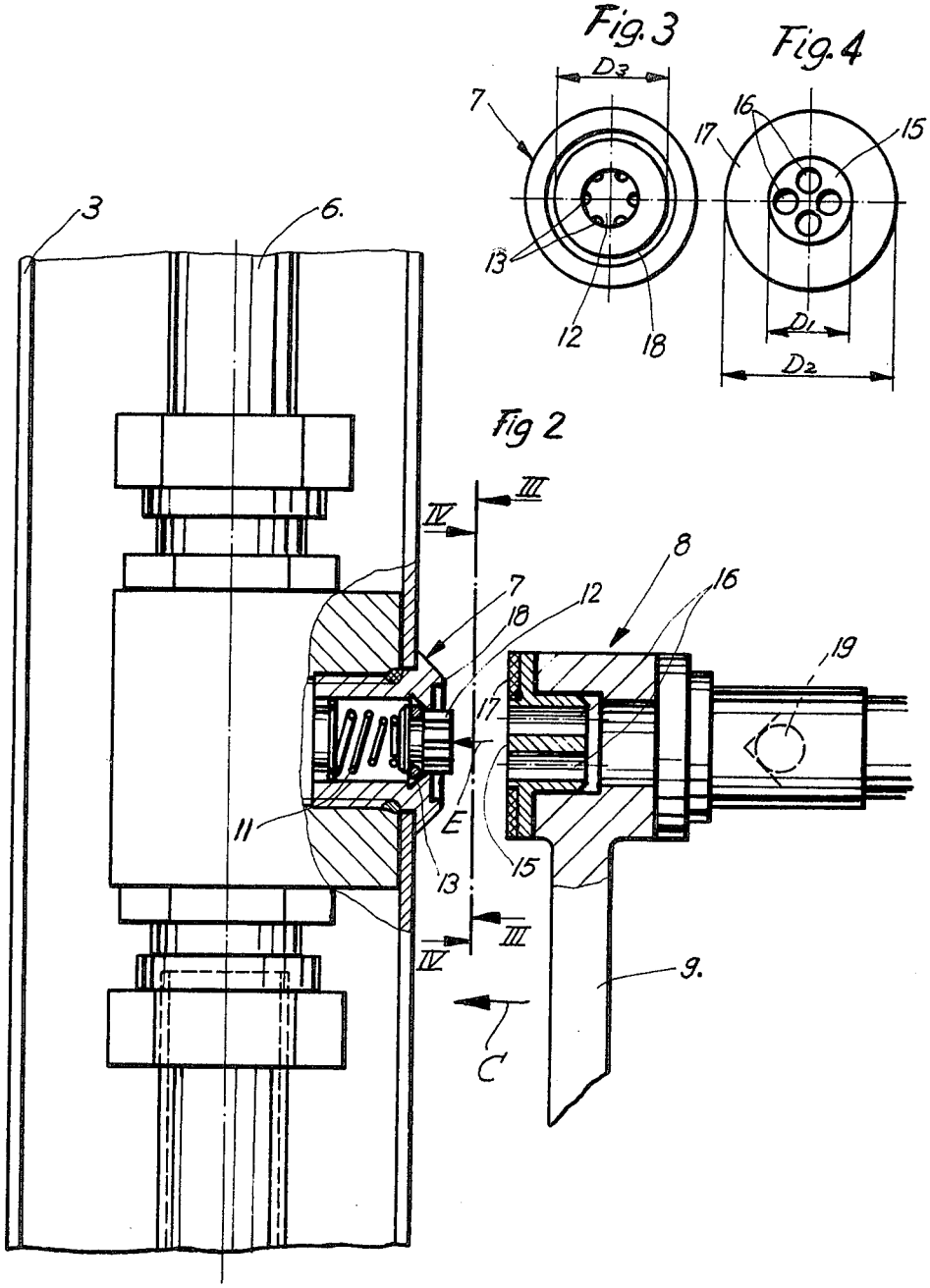
FIG. 2 is a horizontal partial cross-section on the line II—II of FIG. 1.
FIG. 3 is a vertical partial cross-section on the line III—III of FIG. 2.
FIG. 4 is a partial cross-section on the line IV—IV of FIG. 2.

Each of the valves 7 is constructed as an automatically closing button-actuated valve (see FIG. 2). The closure part is a piston 12 loaded by a spring 11, which has an O-ring seal. The piston 12 is provided with a plurality of grooves 14 through which the compressed air can flow as soon as the piston 12 is pressed inwardly into the valve 7 in the direction E and the O-ring seal 13 thereby lifts from the valve seat. Each coupling head 8 also has an opening part 15 for co-operation with the piston 12, the part 15 preferably being constructed as a plate with a plurality of longitudinal bores 16. Via these bores 16 the plate is put in communication with the compressed air system of the service carriage 4.

The plate 15 is surrounded by an annular flat seal 17 of resilient material. This flat seal co-operates with an annular pad 18 provided on the valve 7. The internal diameter D1 of the flat seal 17 is, as can be seen from FIGS. 3 and 4, considerably smaller and the external diameter D2 is considerably larger than the diameter of the annular pad 18. The sealing surface of the flat seal 17 extends in the direction of movement B of the service carriage.

OPERATION

The operation of this compressed air supply device is as follows.

When the service carriage 4 is stopped by a signal in known manner at a spindle to be serviced, the supply of compressed air to the cylinder 10 is opened via a valve, not illustrated. The compressed air still in the compressed air system of the service carriage suffices to fill the cylinder 10 and to move the slide 9 in the direction C towards the valve 7. In the arrangement selected, one of the four coupling heads always registers with a valve. This coupling head bears in sealing manner via its seal 17 on the annular pad 18 of the valve. At the same time the piston 12 is moved by the plate 15 in the direction E and the valve 7 is thereby opened. Communication is now established between the compressed air pipe 6 and the compressed air system of the service carriage 4. In order that the compressed air flowing in through the bores 16 may not flow out again at the other three coupling heads, a non-return valve 19 is associated with each coupling head 8. After the said communication has been established all the pneumatic operations can be performed reliably since any desired quantity of compressed air can be taken from the compressed air pipe 6. The flat seal 17 extending in the direction of movement B of the service carriage has the further advantage that the service carriage does not need to be positioned opposite the frame with an accuracy to a millimeter. Hence for driving the service carriage a conventional brake motor suffices. Any inaccuracies that occur in the positioning of the service carriage are compensated by the flat seal 17, because this can shift by a few millimeters in the direction of movement of the carriage relative to the annular pad 18 without its sealing action being affected.

The embodiments of the invention in which an exclusive property or privilege is claimed are defined as follows:

1. In a compressed air supply arrangement for a service carriage which is supported for travel along the side of at least one spinning, twisting or winding frame having a plurality of equally spaced spindles and a plurality of equally spaced work stations to be serviced and a compressed air system of which is supplied with compressed air from a stationary source of compressed air via a compressed air duct, the improvement comprising wherein said compressed air duct is stationarily arranged at each side of said frame and extends in the longitudinal direction of said frame and is connected to said compressed air source, said air duct having a plurality of automatically closing button-actuated valves connected in circuit therewith, each of said valves having a closure member, wherein the spacing of said valves corresponds to a whole integer multiple of the spindle spacing, and wherein there is provided on said service carriage a plurality of coupling heads arranged one behind another in the direction of movement of said carriage and mounted on a common slide and have a fixed spacing therebetween and means for supporting said common slide for movement transversely to the direction of movement of said carriage and at right angles to said air duct to effect the simultaneous movement of said plural coupling heads toward and away from said air duct, said coupling heads each having an opening member engageable with said closure member for opening said closure member of said valve when firmly engaged with said valve, said coupling heads being connected in fluid circuit to said compressed air system on said service carriage, wherein the spacing between said coupling heads is equal to said spindle spacing and wherein said spacing between said valves is greater by one spindle spacing than the total spacing between the endmost ones of said plurality of coupling heads.

2. The improved arrangement according to claim 1, wherein a compressed air cylinder is provided for driving said common slide.

3. The improved arrangement according to claim 1, wherein a non-return valve is associated with each coupling head.

4. The improved arrangement according to claim 1, wherein said coupling head has as the valve-opening part a plate having a plurality of longitudinal bores.

5. The improved arrangement according to claim 1, wherein said opening member is surrounded by an annular flat seal of resilient material which upon application to the valve abuts tightly against an annular pad.

6. The improved arrangement according to claim 5, wherein the internal diameter of said flat seal is considerably smaller than the diameter of said annular pad and its external diameter is considerably larger than the diameter of said annular pad, the sealing surface of said flat seal extending in the direction of movement of said service carriage.

* * * * *